US009786478B2

(12) United States Patent
Cooks et al.

(10) Patent No.: US 9,786,478 B2
(45) Date of Patent: Oct. 10, 2017

(54) ZERO VOLTAGE MASS SPECTROMETRY PROBES AND SYSTEMS

(71) Applicant: Purdue Research Foundation, West Lafayette, IN (US)

(72) Inventors: Robert Graham Cooks, West Lafayette, IN (US); Michael Stanley Wleklinski, West Lafayette, IN (US); Soumabha Bag, West Lafayette, IN (US); Yafeng Li, Beijing (CN)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 14/957,661

(22) Filed: Dec. 3, 2015

(65) Prior Publication Data

US 2016/0163524 A1 Jun. 9, 2016

Related U.S. Application Data

(60) Provisional application No. 62/107,619, filed on Jan. 26, 2015, provisional application No. 62/088,104, filed on Dec. 5, 2014.

(51) Int. Cl.
*H01J 49/00* (2006.01)
*H01J 49/04* (2006.01)

(52) U.S. Cl.
CPC ..... *H01J 49/0436* (2013.01); *H01J 49/0013* (2013.01)

(58) Field of Classification Search
CPC ..... H01J 49/0436; H01J 49/0013; H01J 49/0027; H01J 49/165
USPC ..... 250/281, 282, 283, 288
See application file for complete search history.

(56) References Cited

U.S. PATENT DOCUMENTS 5,160,841 A * 11/1992 Chapman ..... H01J 49/14 250/281
2007/0278401 A1* 12/2007 Finlay ..... H01J 49/0022 250/289
2012/0326022 A1* 12/2012 Kumano ..... H01J 49/0495 250/282

* cited by examiner

*Primary Examiner* — Nicole Ippolito
(74) *Attorney, Agent, or Firm* — Brown Rudnick LLP; Adam M. Schoen

(57) ABSTRACT

The invention generally relates to zero volt mass spectrometry probes and systems. In certain embodiments, the invention provides a system including a mass spectrometry probe including a porous material, and a mass spectrometer (bench-top or miniature mass spectrometer). The system operates without an application of voltage to the probe. In certain embodiments, the probe is oriented such that a distal end faces an inlet of the mass spectrometer. In other embodiments, the distal end of the probe is 5 mm or less from an inlet of the mass spectrometer.

20 Claims, 13 Drawing Sheets

ZERO VOLTAGE MASS SPECTROMETRY PROBES AND SYSTEMS

RELATED APPLICATIONS

The present application claims the benefit of and priority to U.S. provisional application Ser. No. 62/088,104, filed Dec. 5, 2014, and U.S. provisional application Ser. No. 62/107,619, filed Jan. 26, 2015, the content of each of which is incorporated by reference herein in its entirety.

GOVERNMENT SUPPORT

This invention was made with government support under CHE1307264 awarded by National Science Foundation and DE-FG02-06ER15807 awarded by Department of Energy. The government has certain rights in the invention.

FIELD OF THE INVENTION

The invention generally relates to zero volt mass spectrometry probes and systems.

BACKGROUND

Recent progress in mass spectrometry has depended heavily on advances in methods of ion formation. Creation of stable molecular ions of complex molecules with minimum internal energy has been a primary goal of such experiments. The most widely used methods to achieve this are electrospray ionization (ESI) and matrix-assisted laser desorption ionization (MALDI). The newer ambient ionization methods, such as desorption electrospray ionization (DESI), allow samples to be examined in their native state with minimal or no sample pre-treatment. Those advantages and the resulting speed of analysis have led to the introduction of some fifty different variants of ambient ionization. Direct analysis in real time (DART), extractive electrospray ionization (EESI), desorption atmospheric pressure chemical ionization (DAPCI), desorption atmospheric pressure photoionization (DAPPI), laser ablation electrospray ionization (LAESI), and paper spray ionization, are some of the new methods introduced over the past decade.

Many of those methods use a high voltage source coupled to the probe to achieve ionization in an ambient environment. The application of high voltage can sometimes cause unwanted fragmentation of a target analyte during the ionization process.

SUMMARY

The invention recognizes that ions can be generated from a porous material (e.g., paper) for analysis without any voltage source (0 voltage) given the proper system configuration. Aspects of the invention are accomplished with a probe of a porous material and a mass spectrometer. Solvent is supplied to the porous material, interacts with a sample on or within the porous material, and flows to a distal end of the porous material. Given a short distance between the distal end of the porous material and an inlet of the mass spectrometer, the solvent (now containing one or more analytes of the sample) flows from the porous material into the inlet of the mass spectrometer. Random charging during the breakup of droplets occurs, generating sample ions, which are analyzed within the mass spectrometer. In that manner, systems of the invention generate and analyze ions of a sample without the application of voltage to the porous material (0 volts applied to the porous material).

In certain aspects, the invention provides a system including a mass spectrometry probe including a porous material and a mass spectrometer (bench-top or miniature mass spectrometer). The system operates without an application of voltage to the probe (0 volts applied to the probe). In certain embodiments, ion formation is maximized by positioning the probe to be within a certain distance of the inlet of the mass spectrometer. For example, the probe is oriented such that the porous material faces an inlet of the mass spectrometer and a distal end of the porous material is 5 mm or less from the inlet of the mass spectrometer.

In other embodiments, the distal end includes a tip comprised of the porous material. In such embodiments, the system may be configured such that the tip is about 5 mm from the inlet of the mass spectrometer, for example, the tip can be 4.5 mm from the inlet of the mass spectrometer, 4 mm from the inlet of the mass spectrometer, 3.5 mm from the inlet of the mass spectrometer, 3 mm from the inlet of the mass spectrometer, 2.5 mm from the inlet of the mass spectrometer, 2 mm from the inlet of the mass spectrometer, 1 mm from the inlet of the mass spectrometer, less than 1 mm from the inlet of the mass spectrometer, 900 μm from the inlet of the mass spectrometer, 850 μm from the inlet of the mass spectrometer, 800 μm from the inlet of the mass spectrometer, 750 μm from the inlet of the mass spectrometer, 700 μm from the inlet of the mass spectrometer, 650 μm from the inlet of the mass spectrometer, 600 μm from the inlet of the mass spectrometer, 550 μm from the inlet of the mass spectrometer, 500 μm from the inlet of the mass spectrometer, 450 μm from the inlet of the mass spectrometer, 400 μm from the inlet of the mass spectrometer, 350 μm from the inlet of the mass spectrometer, 300 μm from the inlet of the mass spectrometer, 250 μm from the inlet of the mass spectrometer, 200 μm from the inlet of the mass spectrometer, 150 μm from the inlet of the mass spectrometer, 100 μm from the inlet of the mass spectrometer, 50 μm from the inlet of the mass spectrometer, or less than 50 μm from the inlet of the mass spectrometer.

The porous material can be any porous material. An exemplary porous material is paper, such as filter paper. In certain embodiments, the porous material is modified to facilitate sample separation or flow through the porous material. See for example U.S. Pat. Nos. 8,859,956, and 8,895,918, the content of each of which is incorporated by reference herein in its entirety. In certain embodiments, the porous material includes an internal standard (typically as a component of the porous material prior to application of solvent, e.g., a dried internal standard incorporated into dried porous material). In certain embodiments, the porous material tapers to a tip, such as a porous material including a planar portion that tapers to a tip. An exemplary shape is a triangular porous material that tapers to a tip. In certain embodiments, the system further includes a device for supplying solvent to the mass spectrometry probe, for example, continuous application of solvent to the probe.

In other embodiments, the invention provides methods for analyzing a sample. The methods involve providing a system including a mass spectrometry probe including a porous material and a mass spectrometer, in which the system operates without an application of voltage to the probe. The probe may be oriented such that a distal end faces an inlet of the mass spectrometer. As discussed above, in certain embodiments the tip is 5 mm or less from an inlet of the mass spectrometer. A sample is introduced to the mass spectrometry probe, and ions of the sample are analyzed by introducing those ions into the mass spectrometer from the mass spectrometry probe. Methods of the invention can analyze any type of sample, such as biological and non-biological samples. In certain embodiments, the sample is a biological sample, such as a sample that includes cells, tissue, or body fluid (e.g., blood, urine, saliva, etc.). In other embodiments, the sample is an agricultural or environmental sample.

BRIEF DESCRIPTION OF THE DRAWINGS

FIG. 3 panel B shows sampling and detections procedures. FIG. 3 panels C-D are photographs of the inlet region without and with solvent on the paper, respectively. It was observed that a solvent spray or stream was generated when solvent was applied to the paper.

FIG. 5 panels A) 1 ppm Tributylamine; FIG. 5 panels B) 1 ppm Methamphetamine; FIG. 5 panels C) 1 ppm Terabutylammonium Iodide; FIG. 5 panels D) 10 ppm Reserpine; and four negative samples FIG. 5 panels E) 10 ppm Stearic acid; FIG. 5 panels F) Fludioxonil; FIG. 5 panels G) 10 ppm Sodium benzoate; FIG. 5 panels H) 10 ppm 2,4,5-trichlorophenol.

FIG. 6 panels E-F are the mass spectrum of 50 ppm tributylamine and its corresponding ion chronogram. Tributylamine was added in a continuous manner at 15 μl/min through a fused silica capillary.

FIG. 8 panels D-F are mass spectra of a mixture of 9 ppm morphine and 0.1 ppm tetrabutylammonium iodide using (Panel D) nESI, (Panel E) conventional PS and (Panel F) zero volt PS. The relative intensity of tetrabutylammonium to cocaine/morphine in zero volt PS is much higher than in nESI and conventional PS in both cases. The big differences between the results for cocaine and morphine are the result of the different properties of the analytes. They play more important roles in zero volt PS than in nESI and conventional PS. Note that a scale expansion of more than 100 was used for (Panel C) and (Panel F).

DETAILED DESCRIPTION

Figure 1:
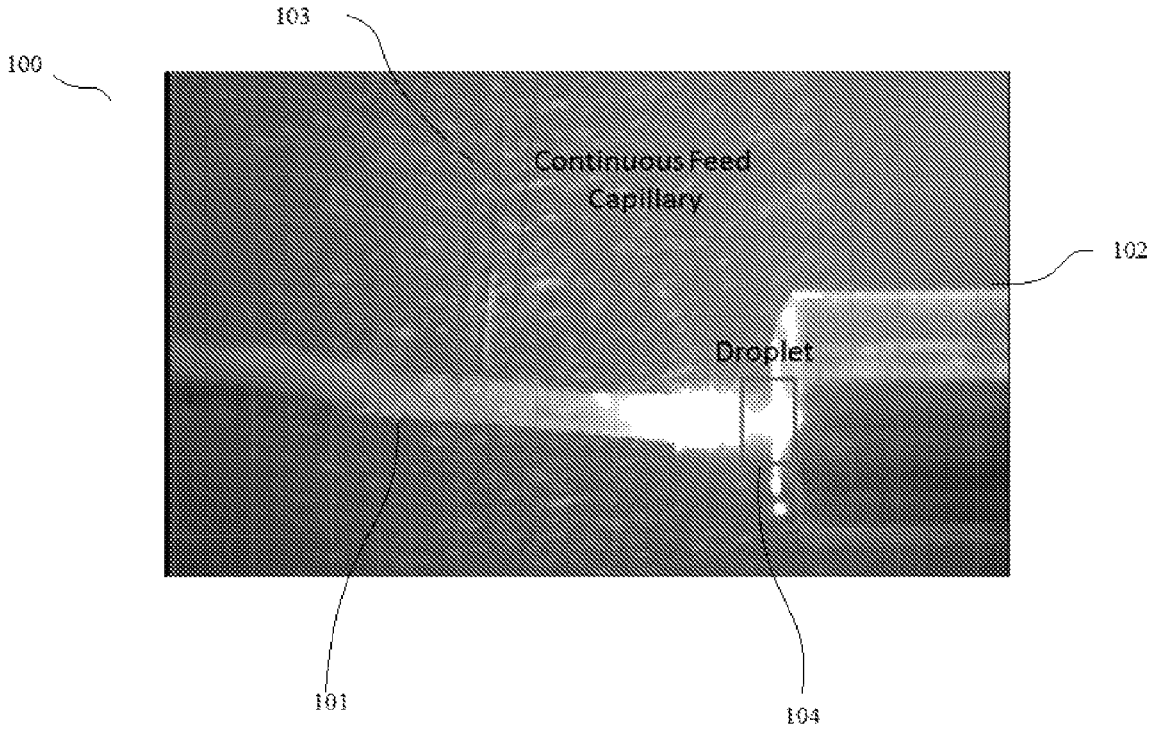
FIG. 1 is a photograph showing a continuous feed system of the invention. A continuous feed (15 μL/min) was supplied to the probe (paper) through the capillary. The paper is positioned approximately 400 μm from inlet. MS signal is observed when a droplet event is seen with the camera in this experiment.

The invention generally relates to zero volt mass spectrometry probes and systems. In certain embodiments, the invention provides a system including a mass spectrometry probe including a porous material and a mass spectrometer (bench-top or miniature mass spectrometer), in which the system operates without an application of voltage to the probe (a zero (0) voltage probe). FIG. 1 shows an exemplary embodiment of systems of the invention. An exemplary system 100 includes a mass spectrometry probe including a porous material 101 and a mass spectrometer 102. FIG. 1 is a close-up view of an inlet of the mass spectrometer 102.

In certain embodiments, the probe 101 is oriented such that the porous material faces an inlet of the mass spectrometer 102. In certain embodiments, ion formation is maximized by positioning the probe to be within a certain distance of the inlet of the mass spectrometer 102. For example, a distal end of the porous material of the probe 102 may be 5 mm or less from the inlet of the mass spectrometer. For example, the distal end can be 4.5 mm from the inlet of the mass spectrometer, 4 mm from the inlet of the mass spectrometer, 3.5 mm from the inlet of the mass spectrometer, 3 mm from the inlet of the mass spectrometer, 2.5 mm from the inlet of the mass spectrometer, 2 mm from the inlet of the mass spectrometer, 1 mm from the inlet of the mass spectrometer, less than 1 mm from the inlet of the mass spectrometer, 900 μm from the inlet of the mass spectrometer, 850 μm from the inlet of the mass spectrometer, 800 μm from the inlet of the mass spectrometer, 750 μm from the inlet of the mass spectrometer, 700 μm from the inlet of the mass spectrometer, 650 μm from the inlet of the mass spectrometer, 600 μm from the inlet of the mass spectrometer, 550 μm from the inlet of the mass spectrometer, 500 μm from the inlet of the mass spectrometer, 450 μm from the inlet of the mass spectrometer, 400 μm from the inlet of the mass spectrometer, 350 μm from the inlet of the mass spectrometer, 300 μm from the inlet of the mass spectrometer, 250 μm from the inlet of the mass spectrometer, 200 μm from the inlet of the mass spectrometer, 150 μm from the inlet of the mass spectrometer, 100 μm from the inlet of the mass spectrometer, 50 μm from the inlet of the mass spectrometer, or less than 50 μm from the inlet of the mass spectrometer.

The shape of the distal end of the probe 102 is not critical to the function of the probe. That is, the distal end may have any shape, such as a flat edge, a rounded edge, a point (e.g. tip) or any other shape. However, a distal shape of a tip may be most efficient for solvent transfer and ion formation. In the exemplary embodiment in FIG. 1 the distal tip of the probe 102 is shown as a tip, which tip is comprised of the porous material. In such embodiments, the system may be configured such that the tip is at most 5 mm from the inlet of the mass spectrometer 102, for example, the tip can be 4.5 mm from the inlet of the mass spectrometer, 4 mm from the inlet of the mass spectrometer, 3.5 mm from the inlet of the mass spectrometer, 3 mm from the inlet of the mass spectrometer, 2.5 mm from the inlet of the mass spectrometer, 2 mm from the inlet of the mass spectrometer, 1 mm from the inlet of the mass spectrometer, less than 1 mm from the inlet of the mass spectrometer, 900 μm from the inlet of the mass spectrometer, 850 μm from the inlet of the mass spectrometer, 800 μm from the inlet of the mass spectrometer, 750 μm from the inlet of the mass spectrometer, 700 μm from the inlet of the mass spectrometer, 650 μm from the inlet of the mass spectrometer, 600 μm from the inlet of the mass spectrometer, 550 μm from the inlet of the mass spectrometer, 500 μm from the inlet of the mass spectrometer, 450 μm from the inlet of the mass spectrometer, 400 μm from the inlet of the mass spectrometer, 350 μm from the inlet of the mass spectrometer, 300 μm from the inlet of the mass spectrometer, 250 μm from the inlet of the mass spectrometer, 200 μm from the inlet of the mass spectrometer, 150 μm from the inlet of the mass spectrometer, 100 μm from the inlet of the mass spectrometer, 50 μm from the inlet of the mass spectrometer, or less than 50 μm from the inlet of the mass spectrometer.

In certain embodiments, the probe 101 is coupled to a continuous solvent flow or a solvent reservoir so that the porous material of the probe 101 can be continuously supplied with solvent. Such an exemplary set-up is described in FIG. 1, which shows a continuous feed capillary 103 for continuous supply of solvent to the porous material of the probe 101.

In other embodiments, the probe including the porous material 101 is kept discrete (i.e., separate or disconnected) from a flow of solvent, such as a continuous flow of solvent. Instead, sample is either spotted onto the porous material of the probe 101 or swabbed onto it from a surface including the sample. The spotted or swabbed sample is then positioned within sufficient proximity (e.g., 5 mm or less) of the inlet of the mass spectrometer 102 and solvent flows from the porous material and into the mass spectrometer 102. The sample can be transported through the porous material without the need of a separate solvent flow.

Operation of the systems of the invention is discussed in greater detail in the Examples below. Briefly and without being limited by any particular theory or mechanism of action, it is believed that a suction force of the inlet of the mass spectrometer 102 causes the release of analyte-containing droplets 104 from the probe 101, which are sampled by the mass spectrometer 102. The released analyte-containing droplet 104 experiences aerodynamic forces as it is pulled into the mass spectrometer by the suction of the vacuum system. These aerodynamic forces break apart the droplets 104 until they reach a size on the order of 1 to 4 μm where the aerodynamic forces are no longer strong enough to cause further droplet breakup. After aerodynamic breakup, droplets will undergo multiple evaporation and Coulombic fission until they are ionized by either of the main ESI models, the charge residue model (CRM) or ion evaporation model (IEM).

The solvent may assist in separation/extraction and ionization. Any solvents may be used that are compatible with mass spectrometry analysis. In particular embodiments, favorable solvents will be those that are also used for electrospray ionization. Exemplary solvents include combinations of water, methanol, acetonitrile, and tetrahydrofuran (THF). The organic content (proportion of methanol, acetonitrile, etc. to water), the pH, and volatile salt (e.g. ammonium acetate) may be varied depending on the sample to be analyzed. For example, basic molecules like the drug imatinib are extracted and ionized more efficiently at a lower pH. Molecules without an ionizable group but with a number of carbonyl groups, like sirolimus, ionize better with an ammonium salt in the solvent due to adduct formation. In certain embodiments, the solvent includes an internal standard. Exemplary solvent systems are also described in U.S. Pat. No. 8,859,956, U.S. Pat. No. 9,157,921, and U.S. Pat. No. 9,024,254, the content of each of which is incorporated by reference herein in its entirety.

In certain embodiments, pneumatic assistance applied to the probe 101 is not required to transport the analyte; rather, the porous material is held in front of a mass spectrometer, e.g., at 5 mm or less from the inlet, and droplets are suctioned into the inlet of the mass spectrometer. As used herein, the suction of droplets from the distal end of the probe by the vacuum of the mass spectrometer is not considered pneumatic assistance applied to the probe 101. As used herein, pneumatic assistance refers to a separate expelling gas flow that is applied directly to the probe 101, such as a nebulizing gas flow or the type of gas flow used in sonic spray ionization (SSI; described for example in Hirabayash et al., Analytical Chemistry, 66 (1994) 4557-4559, or Hirabayashi et al., Analytical Chemistry, 67 (1995) 2878-2882) or desorption sonic spray ionization (DeSSI, also referred to as easy ambient sonic-spray ionization (EASI), described for example in Haddad et al., Rapid Communications in Mass Spectrometry, 20 (2006) 2901-2905, Haddad et al., Analytical Chemistry, 80 (2008) 898-903, or Haddad et al., Analytical Chemistry, 80 (2008) 2744-2750). Accordingly, a probe of the invention that operates without pneumatic assistance is a probe that does not require use of an expelling gas flow applied directly to the probe.

In other embodiments, probes of the invention, including a porous material, do operate with pneumatic assistance, i.e., with the use of an expelling gas flow applied directly to the probe, e.g., nebulizing gas flow. Probes of the invention, including a porous material, that operate with pneumatic assistance and without voltage are useful when longer distances between a distal end of the probe and the inlet of the mass spectrometer are desired. For example, a distance between a distal end of the probe and the inlet of the mass spectrometer that is greater than 5 mm, e.g, 5.5 mm, 6 mm, 6.5 mm, 7 mm, 7.5 mm, 8 mm, 8.5 mm, 9 mm, 9.5 mm, 10 mm, 15 mm, 20 mm, 25 mm, 30 mm, 40 mm, 50 mm, 60 mm, 70 mm, 80 mm, 90 mm, 100 mm, and greater, which will depend on the flow of gas applied directly to the probe.

In other or in addition to the above described embodiments, probes of the invention operates without the need for thermal energy to generate droplets (e.g., probes of the invention operate without thermal and/or pneumatic assistance). Rather, the probes of the invention can operate at room temperature and without pneumatic assistance.

Numerous different types of porous materials can be used in the probes of the invention. Porous materials are described for example in U.S. Pat. Nos. 8,859,956 and 8,895,918, the content of which is incorporated by reference herein in its entirety. In certain embodiments, the porous material is any cellulose-based material. In other embodiments, the porous material is a non-metallic porous material, such as cotton, linen wool, synthetic textiles, or plant tissue (e.g., a leaf). In still other embodiments, the porous material is paper. Advantages of paper include: cost (paper is inexpensive); it is fully commercialized and its physical and chemical properties can be adjusted; it can filter particulates (cells and dusts) from liquid samples; it is easily shaped (e.g., easy to cut, tear, or fold); liquids flow in it under capillary action (e.g., without external pumping and/or a power supply); and it is disposable.

In particular embodiments, the porous material is filter paper. Exemplary filter papers include cellulose filter paper, ashless filter paper, nitrocellulose paper, glass microfiber filter paper, and polyethylene paper. Filter paper having any pore size may be used. Exemplary pore sizes include Grade 1 (11 μm), Grade 2 (8 μm), Grade 595 (4-7 μm), and Grade 6 (3 μm), Pore size will not only influence the transport of liquid inside the spray materials, but could also affect the formation of the Taylor cone at the tip. The optimum pore size will generate a stable Taylor cone and reduce liquid evaporation. The pore size of the filter paper is also an important parameter in filtration, i.e., the paper acts as an online pretreatment device. Commercially available ultrafiltration membranes of regenerated cellulose, with pore sizes in the low nm range, are designed to retain particles as small as 1000 Da. Ultra filtration membranes can be commercially obtained with molecular weight cutoffs ranging from 1000 Da to 100,000 Da.

In particular embodiments, the porous material is shaped to have a macroscopically sharp point, such as a point of a triangle, for ion generation. Probes of the invention may have different tip widths. In certain embodiments, the probe tip width is at least about 5 μm or wider, at least about 10 μm or wider, at least about 50 μm or wider, at least about 150 μm or wider, at least about 250 μm or wider, at least about 350 μm or wider, at least about 400μ or wider, at least about 450 μm or wider, etc. In particular embodiments, the tip width is at least 350 μm or wider. In other embodiments, the probe tip width is about 400 μm. In other embodiments, probes of the invention have a three dimensional shape, such as a conical shape. In certain embodiments, the substrate tapers to a tip, such as a substrate including a planar portion that tapers to a tip. An exemplary shape is a triangular substrate that tapers to a tip.

Mass spectrometry probes of the invention can be interfaced with mass spectrometers for analysis of samples. As mentioned above, no pneumatic assistance is required to transport the droplets. Ambient ionization of analytes is realized on the basis of random charging during the breakup of droplets. Sample solution is directly applied on the probe held in front of an inlet of a mass spectrometer without any pretreatment.

Any type of mass spectrometer known in the art can be used with proves of the invention. For example, the mass spectrometer can be a standard, bench-top mass spectrometer. In other embodiments, the mass spectrometer is a miniature mass spectrometer. An exemplary miniature mass spectrometer is described, for example in Gao et al. (Z. Anal. Chem. 2006, 78, 5994-6002), the content of which is incorporated by reference herein in its entirety In comparison with the pumping system used for lab-scale instruments with thousands watts of power, miniature mass spectrometers generally have smaller pumping systems, such as a 18 W pumping system with only a 5 L/min (0.3 m3/hr) diaphragm pump and a 11 L/s turbo pump for the system described in Gao et al. Other exemplary miniature mass spectrometers are described for example in Gao et al. (Anal. Chem., 80:7198-7205, 2008), Hou et al. (Anal. Chem., 83:1857-1861, 2011), and Sokol et al. (Int. J. Mass Spectrom., 2011, 306, 187-195), the content of each of which is incorporated herein by reference in its entirety. Miniature mass spectrometers are also described, for example in Xu et al. (JALA, 2010, 15, 433-439); Ouyang et al. (Anal. Chem., 2009, 81, 2421-2425); Ouyang et al. (Ann. Rev. Anal. Chem., 2009, 2, 187-214); Sanders et al. (Euro. J. Mass Spectrom., 2009, 16, 11-20); Gao et al. (Anal. Chem., 2006, 78(17), 5994-6002); Mulligan et al. (Chem. Com., 2006, 1709-1711); and Fico et al. (Anal. Chem., 2007, 79, 8076-8082).), the content of each of which is incorporated herein by reference in its entirety.

In certain embodiments, systems of the invention are equipped with a discontinuous interface, which is particularly useful with miniature mass spectrometers. An exemplary discontinuous interface is described for example in Ouyang et al. (U.S. Pat. No. 8,304,718), the content of which is incorporated by reference herein in its entirety. In certain embodiments, it is advantage to heat the sample during analysis. Accordingly, in certain embodiments, mass spectrometry probes of the invention are configured with a heating element, such as described in Cooks et al. (U.S. patent application publication number 2013/0344610), the content of which is incorporated by reference herein in its entirety.

In certain embodiments, methods and systems of the invention use a porous material, e.g., paper, to hold and transport analytes for mass spectral analysis. Analytes in samples are pre-concentrated, enriched and purified in the porous material in an integrated fashion for generation of ions from the porous material. In certain embodiments, transport solution (e.g., a few droplets or a continuous flow of solvent) is applied to assist movement of the analytes through the porous material. In certain embodiments, the analyte is already in a solution that is applied to the porous material. In such embodiments, no additional solvent need be added to the porous material. In other embodiments, the analyte is in a powdered sample that can be easily collected by swabbing a surface. Systems and methods of the invention allow for analysis of plant or animal tissues, or tissues in living organisms.

Methods and systems of the invention can be used for analysis of a wide variety of small molecules, including epinephrine, serine, atrazine, methadone, roxithromycin, cocaine and angiotensin I or molecular complexes (e.g., protein and peptide complexes). All display high quality mass and MS/MS product ion spectra from a variety of porous surfaces. Methods and systems of the invention allow for use of small volumes of solution, typically a few μl, with analyte concentrations on the order of 0.1 to 10

μg/mL (total amount analyte 50 pg to 5 ng) and give signals that last from one to several minutes.

Methods and systems of the invention can be used also for analysis of a wide variety of biomolecules, including proteins and peptides and bimolecular complex (protein or peptide complexes). Methods of the invention can also be used to analyze oligonucleotides from gels. After electrophoretic separation of oligonucleotides in the gel, the band or bands of interest are blotted with porous material using methods known in the art. The blotting results in transfer of at least some of the oligonucleotides in the band in the gel to the probes of the invention. The probe is then held in front of an inlet of a mass spectrometer such that the probe tip is less than 5 mm from the inlet, and the oligonucleotides are introduced and ionized in the mass spectrometer for mass spectral analysis.

Methods and systems of the invention can be used for analysis of complex mixtures, such as whole blood or urine. The typical procedure for the analysis of pharmaceuticals or other compounds in blood is a multistep process designed to remove as many interferences as possible prior to analysis. First, the blood cells are separated from the liquid portion of blood via centrifugation at approximately 1000×g for 15 minutes (Mustard, J. R; Kinlough-Rathbone, R. L.; Packham, M. A. Methods in Enzymology; Academic Press, 1989). Next, the internal standard is spiked into the resulting plasma and a liquid-liquid or solid-phase extraction is performed with the purpose of removing as many matrix chemicals as possible while recovering nearly all of the analyte (Buhrman, D. L.; Price, P. I.; Rudewicz, P. J. Journal of the American Society for Mass Spectrometry 1996, 7, 1099-1105). The extracted phase is typically dried by evaporating the solvent and then resuspended in the a solvent used as the high performance liquid chromatography (HPLC) mobile phase (Matuszewski, B. K.; Constanzer, M. L.; Chavez-Eng, C. M., Ithaca, N.Y., July 23-25 1997; 882-889). Finally, the sample is separated in the course of an HPLC run for approximately 5-10 minutes, and the eluent is analyzed by electrospray ionization-tandem mass spectrometry (Hopfgartner, G.; Bourgogne, E. Mass Spectrometry Reviews 2003, 22, 195-214).

Methods and systems of the invention avoid the above sample work-up steps. Methods and systems of the invention analyze a dried blood spots in a similar fashion, with a slight modification to the extraction procedure. First, a specialized device is used to punch out identically sized discs from each dried blood spot. The material on these discs is then extracted in an organic solvent containing the internal standard (Chace, D. H.; Kalas, T. A.; Naylor, E. W. Clinical Chemistry 2003, 49, 1797-1817). The extracted sample is dried on the paper substrate, and the analysis proceeds as described herein.

Methods and systems of the invention can directly detect individual components of complex mixtures, such as caffeine in urine, 50 pg of cocaine on a human finger, 100 pg of heroin on a desktop surface, and hormones and phospholipids in intact adrenal tissue, without the need for sample preparation prior to analysis. Methods and systems of the invention allow for simple imaging experiments to be performed by examining, in rapid succession, needle biopsy tissue sections transferred directly to paper.

Analytes from a solution are applied to the probe for examination and the solvent component of the solution can serve as the electrospray solvent. In certain embodiments, analytes (e.g., solid or solution) are pre-spotted onto the porous material, e.g., paper, and a solvent is applied to the material to dissolve and transport the analyte into a spray for mass spectral analysis.

In certain embodiments, a solvent is applied to the porous material to assist in separation/extraction and ionization. Any solvents may be used that are compatible with mass spectrometry analysis. In particular embodiments, favorable solvents will be those that are also used for electrospray ionization. Exemplary solvents include combinations of water, methanol, acetonitrile, and THE. The organic content (proportion of methanol, acetonitrile, etc. to water), the pH, and volatile salt (e.g. ammonium acetate) may be varied depending on the sample to be analyzed. For example, basic molecules like the drug imatinib are extracted and ionized more efficiently at a lower pH. Molecules without an ionizable group but with a number of carbonyl groups, like sirolimus, ionize better with an ammonium salt in the solvent due to adduct formation.

In certain embodiments, a multi-dimensional approach is undertaken. For example, the sample is separated along one dimension, followed by ionization in another dimension. In these embodiments, separation and ionization can be individually optimized, and different solvents can be used for each phase.

In certain embodiments, chemicals are applied to the probe to modify the chemical properties of the probe. For example, chemicals can be applied that allow differential retention of sample components with different chemical properties. Additionally, chemicals can be applied that minimize salt and matrix effects. In other embodiments, acidic or basic compounds are added to the porous material to adjust the pH of the sample upon spotting. Adjusting the pH may be particularly useful for improved analysis of biological fluids, such as blood. Additionally, chemicals can be applied that allow for on-line chemical derivatization of selected analytes, for example to convert a non-polar compound to a salt for efficient electrospray ionization.

In certain embodiments, the chemical applied to modify the porous material is an internal standard. The internal standard can be incorporated into the material and released at known rates during solvent flow in order to provide an internal standard for quantitative analysis. In other embodiments, the porous material is modified with a chemical that allows for pre-separation and pre-concentration of analytes of interest prior to mass spectrum analysis.

The methodology described here has desirable features for clinical applications, including neo-natal screening, therapeutic drug monitoring and tissue biopsy analysis. The procedures are simple and rapid. The porous material serves a secondary role as a filter, e.g., retaining blood cells during analysis of whole blood. Significantly, samples can be stored on the porous material and then analyzed directly from the stored porous material at a later date without the need transfer from the porous material before analysis. Systems of the invention allow for laboratory experiments to be performed in an open laboratory environment.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

The performance and mechanism of zero volt paper spray are presented here. No voltage is applied to the paper or mass spectrometry (MS) inlet. The spray is generated with assistance from the MS vacuum system at the inlet. Both positive and negative ion signals are observed without any change in the conditions. The statistical fluctuation of positive and negative ions as droplets are created from bulk solution, which explains the ionization mechanism using these zero applied potential conditions. In the sample solution being analyzed, a fraction of analyte(s) exist as solvated ions. Droplet breakup and desolvation allows for the simultaneous detection of positive and negative ions, free of solvent and counter-ions. Droplet breakup occurs primarily by a two-step method. First large droplets are broken up by aerodynamic forces and then aerodynamically stable droplets undergo multiple rounds of evaporation and coulombic fission, which allows for the production of gaseous ions. A Monte Carlo simulation based on the statistical fluctuation of positive and negative ions in solution has been developed to explain the production of gaseous ions. This statistical model for zero volt paper spray ionization may also help explain the ionization mechanisms of the other zero volt spray ionization methods.

Example 1: Zero Voltage Mass Spectrometry Probe and System

Figure 2:
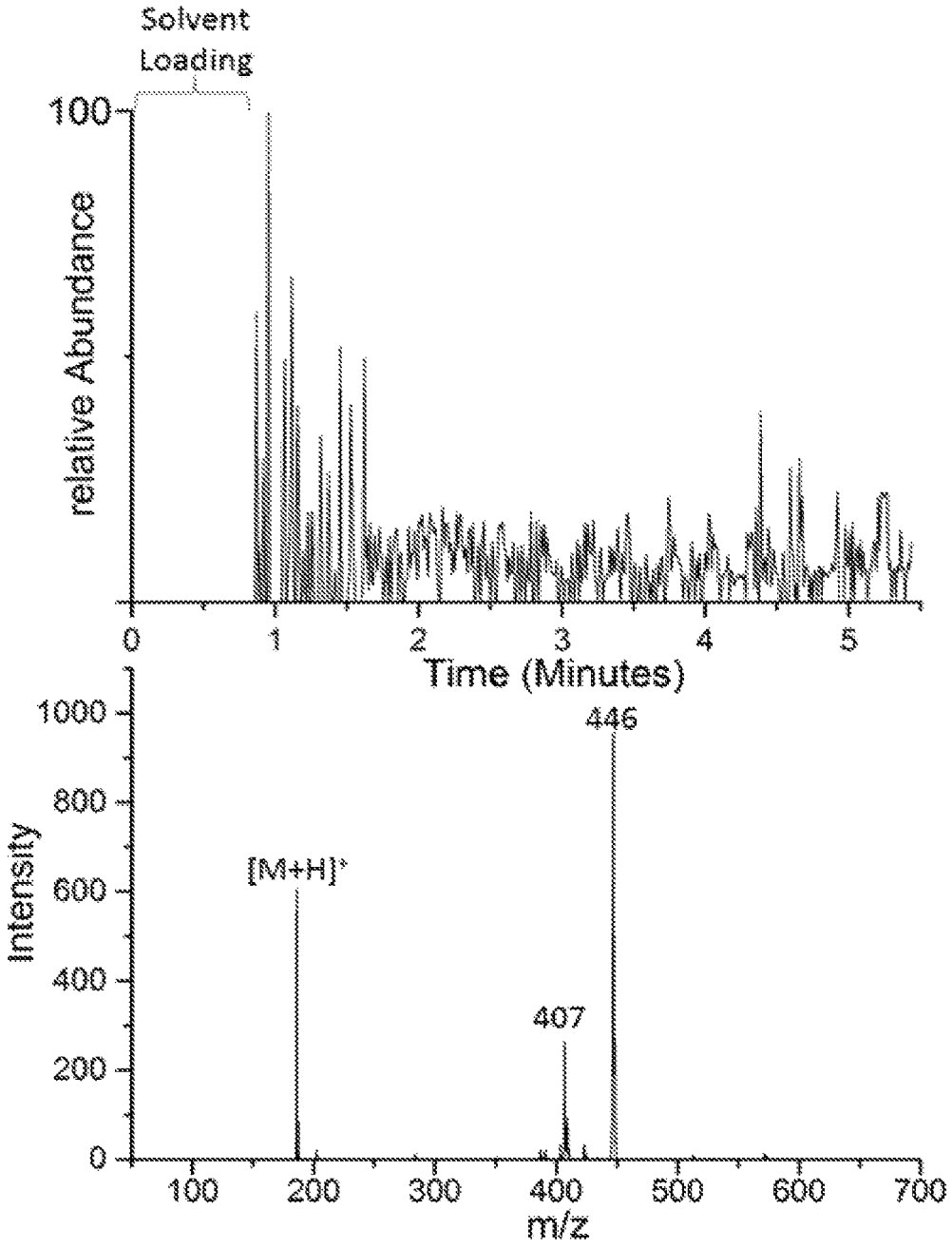
FIG. 2 shows a typical 0 Volt TIC and mass spectra. A stable signal can be achieved utilizing 15 μL/min flow rate, with 50 ppm tributylamine (M.W. 185). In this case 0 volts was applied to the paper, while being held ~400 μm from the inlet. The mass spectrum in the bottom represent an average of minutes 2-4.

A new setup was utilized to precisely control the distance of a paper mass spectrometry probe from an MS inlet and video of the experiment was recorded (FIG. 1). The system operated without the application of voltage to the paper probe (zero volts applied to the probe). To do this, an xyz micrometer stage and 30 fps camera (Watec Wat-704R) were utilized. Under previously described conditions (50 ppm TPP in 5 μl additions or continuous feed at 12-20 μl/min) suction of droplets into the MS can be observed (FIG. 1). In this embodiment, the distance of the paper was within 500 μm of the inlet in conjunction with wetting the paper such that a visible bulge of solvent was seen on the paper (typically three 5 μL additions was enough). A typical TIC and mass spectrum are indicated in FIG. 2. In the first region there is no signal while the solvent flows to the paper, and then a semi-continuous signal is observed for long periods of time. In this case the ionization was independent of paper type and voltage, i.e., ionization occurs without the application of any voltage (zero volts). The proposed mechanism here is random charging during the breakup of droplets (Dodd, The Statistics of Liquid Spray and Dust Electrification by the Hopper and Laby Method, Journal of Applied Physics, 1953).

Example 2: Mechanism of Zero Volt Paper Spray Ionization

The data herein show that by removing the applied voltage entirely, a zero volt form of paper spray (PS) can be performed. This approach retains the advantage of the paper substrate while removing the electric field and also dispensing with the strong pneumatic forces needed in the pneumatic assisted ionization methods of SSI and EASI. In zero volt PS the vacuum of a mass spectrometer provides a pneumatic force. The results show that the zero volt PS method gives both positive and negative ions just as do conventional PS and nanoelectrospray ionization (nESI). Simulations have been done to test a possible ionization mechanism. The proposed mechanism includes charge separation during droplet formation due to statistical fluctuations in positive and negative ion distributions and aerodynamic breakup. Subsequently evaporation and coulombic fission processes follow ESI mechanisms.

Chemicals and Materials

Deionized water was provided by a Milli-Q Integral water purification system (Barnstead Easy Pure II). Methamphetamine, morphine and cocaine were purchased from Cerilliant. Other samples were all purchased from Sigma (St. Louis, Mo., USA). All samples were examined in methanol solution except where noted. Methanol used here was from Mallinckrodt Baker Inc. (Phillipsburg, N.J.). Deuterated methanol and water were provided by Cambridge Isotope Laboratories (Tewksbury, Mass.). The paper used as the spray substrate was Whatman 1 chromatography paper (Whatman International Ltd., Maidstone, England).

Zero Volt PS

Figure 3:
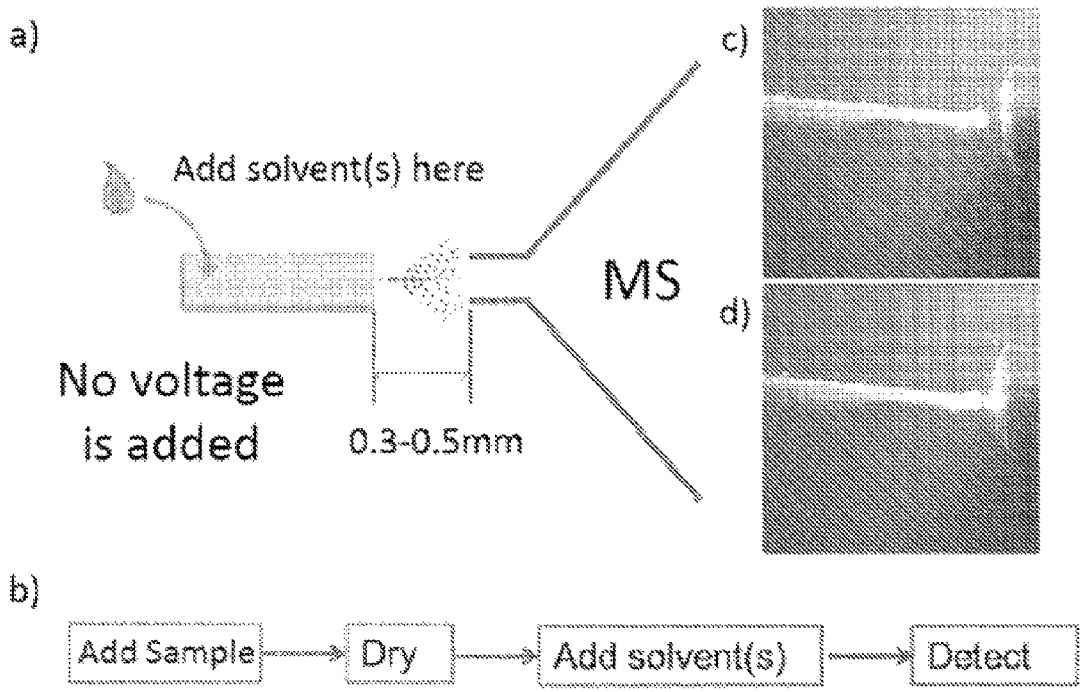
FIG. 3 panel A is an overview of the zero-volt PS process. The distance between the front edge of the paper and the MS inlet is 0.3-0.5 mm. No voltage was applied to either the paper or the MS inlet capillary. The suction force of the MS inlet causes the release of analyte-containing droplets, which are sampled by the mass spectrometer.

FIG. 3 panel A shows the experimental details of zero volt PS. Unlike traditional paper spray, the tip of z triangle-shaped paper was not needed, because zero volt PS operates without application of voltage. Accordingly, there was no need to create a high field, and a rectangular piece of paper was used (FIG. 3 panel A). Virtually any shape could be used in this system. An xyz micrometer moving stage (Parker Automation, USA) was used to control the distance between the front edge of the paper and the MS inlet in the range 0.3 mm to 0.5 mm. A camera (Watec Wat-704R) was used to observe the spray process and help in positioning the paper. A red laser pointer was used to illuminate the spray. The paper was cut to 8 by 4 mm and placed in a toothless alligator clip (McMaster-Carr, USA Part 7236K51). No voltage was applied to the paper or the capillary of the MS, instead the spray was generated by the pneumatic forces at play near the MS inlet. FIG. 3 panel B depicts a typical method used for detection of analytes, in which 5 μl of sample dissolved in methanol was loaded onto the paper, and left to dry. During the drying time, the paper was positioned appropriately in respect to the MS. 1:1 Methanol:water solvent (7 μl each application, applied three times, 1:1 v/v) was applied to the paper to generate the spray and detect the signal. For each 7 μl aliquot of solvent, the signal would last for about 10 s. Micropipette tips were used to load solvent onto the paper. FIG. 3 panels C-D are photographs taken without and with solvent on the paper, respectively. Clearly, droplets are only observed in the presence of solvent.

Computational Details

All programs used in the simulation of zero volt PS were coded in Python 3.4.2 and computed using computation resources provided by Information Technology at Purdue Research Computing (RCAC) on the Carter supercomputer. Other coding systems with similar capabilities could also be used to generate a simulation code. Smaller codes were tested on a small desktop computer (core i3).

Instrumentation

Mass spectra were acquired using a Thermo Fisher LTQ mass spectrometer (Thermo Scientific Inc., San Jose, Calif.). The MS inlet capillary temperature was kept at 200° C., and the tube lens voltage and the capillary voltage were held at zero volts for both positive and negative ion detection. Collision-induced dissociation (CID) was used to carry out tandem mass spectrometry analysis on precursor ions mass-selected using windows of two mass units. To record the corresponding conventional PS spectra, 3.5 kV and 2.0 kV were used in the positive and negative ion modes respectively, and for nESI, 1.5 kV was used in both modes. The same CID conditions were used for the analysis of all samples regardless of ionization method.

Characteristics of 0 Volt PS Mass Spectra

Figure 4:
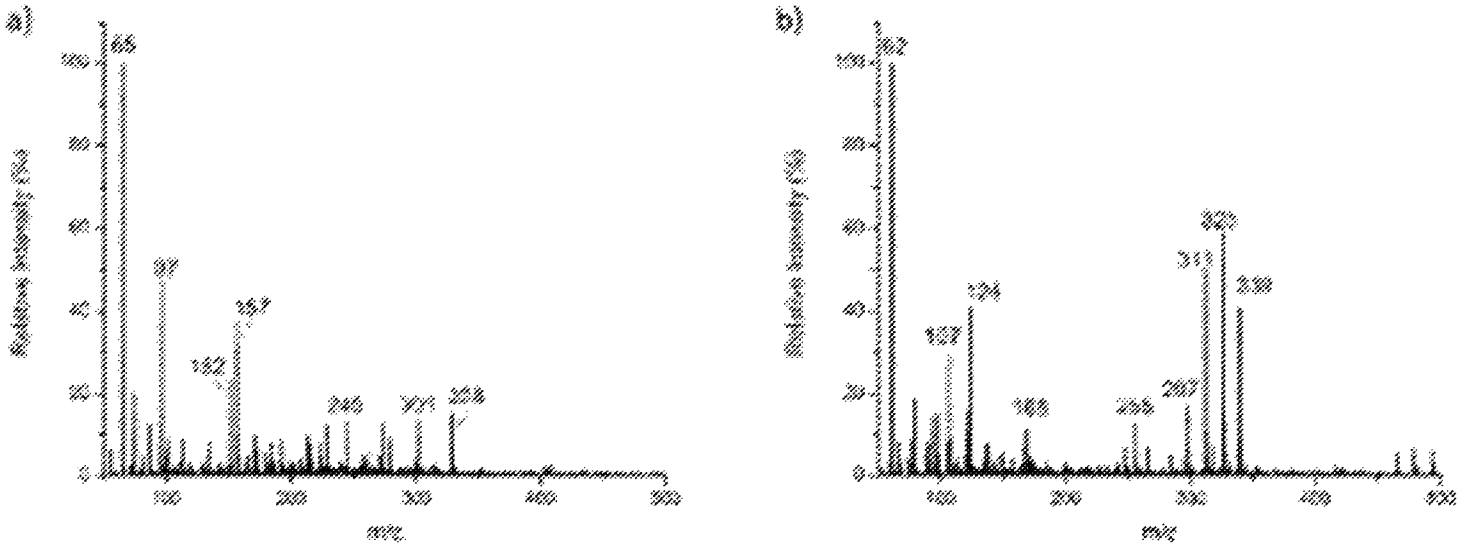
FIG. 4 panels A-B are mass spectra showing blank signals of zero volt paper spray in positive mode (FIG. 4 panels A) and negative mode (FIG. 4 panels B).
Figure 5:
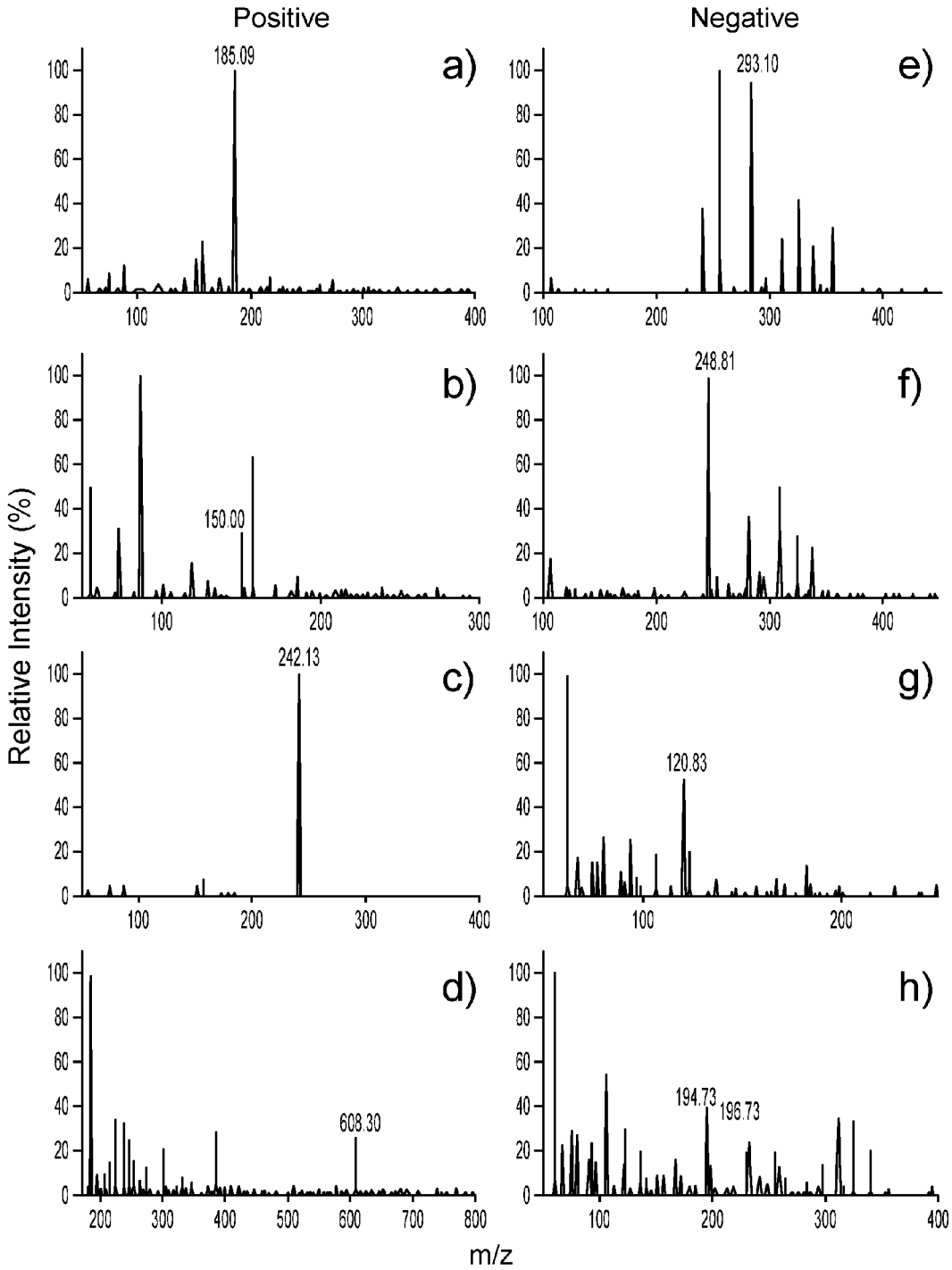
FIG. 5 panels A-H show mass spectra of zero volt PS of four analytes recorded in the positive ion mode.

In the absence of analytes (blanks), zero volt conditions produce signals in both ion polarities (FIG. 4). Presumably this signal arises from the trace containments present in methanol and water and from residual contamination in the mass spectrometer. A variety of samples were used to test the ionization capabilities of zero volt PS. As shown in FIG. 5 panels A-H, both positive and negative signals are obtained, including corresponding MS/MS signals. The MS/MS results for zero volt PS are almost identical to those for the same ions generated by nESI and conventional PS. All these results show that the range of analysis of the zero volt PS is very similar to conventional PS and nESI.

Figure 6:
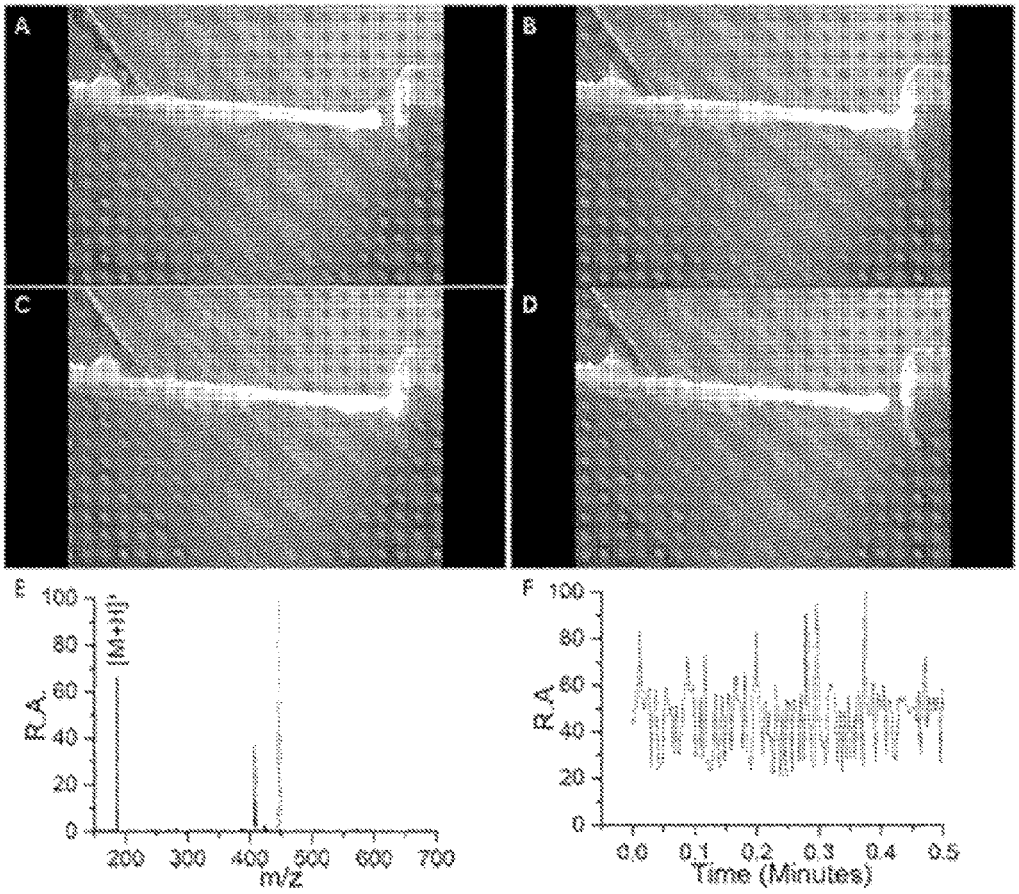
FIG. 6 panels A-D are consecutive images of the spray process occurring at 0 Volts. The spray is illuminated with a red laser pointer and captured on a Watec Wat-704R camera. Panels A-D show a droplet event over the course of 4 consecutive scans. The time elapsed is around 100 milliseconds.

An experiment was performed to determine the optimal distance between the paper and MS inlet that allows observation of the best signal. Without external forces and with the instrument and paper used, it was observed that the optimal results were obtained when the paper was within 1 mm of the inlet for the observation of droplets to occur. As the distance between the distal end of the probe and the MS inlet got larger (e.g., greater than 5 mm), an external force, such as an applied voltage or additional pneumatic force, was helpful (Nebulizing gas flow). A distance of 0.3-0.5 mm was chosen due to lower fluctuations in signal intensity. The spray process was monitored using a 30 Hz camera. In this experiment 50 ppm of tributylamine was fed continuously onto the paper at a flow rate of 15 μl/min. This generated a continuous chronogram (FIG. 6 panels E-F). The spray was illuminated with a handheld red laser pointer and simultaneously videographed. FIG. 6 panels A-D show the suction of one droplet over the course of 4 consecutive images. This indicates that a single suction event occurs in a time on the order of ~100 ms. This was repeated by using manual additions of solvent (7 μl) and similar droplet events are observed. Signal was only observed when a droplet event was recorded by the camera, indicating that droplets were necessary to produce gas phase ions.

The Sources of the Protons

Figure 7:
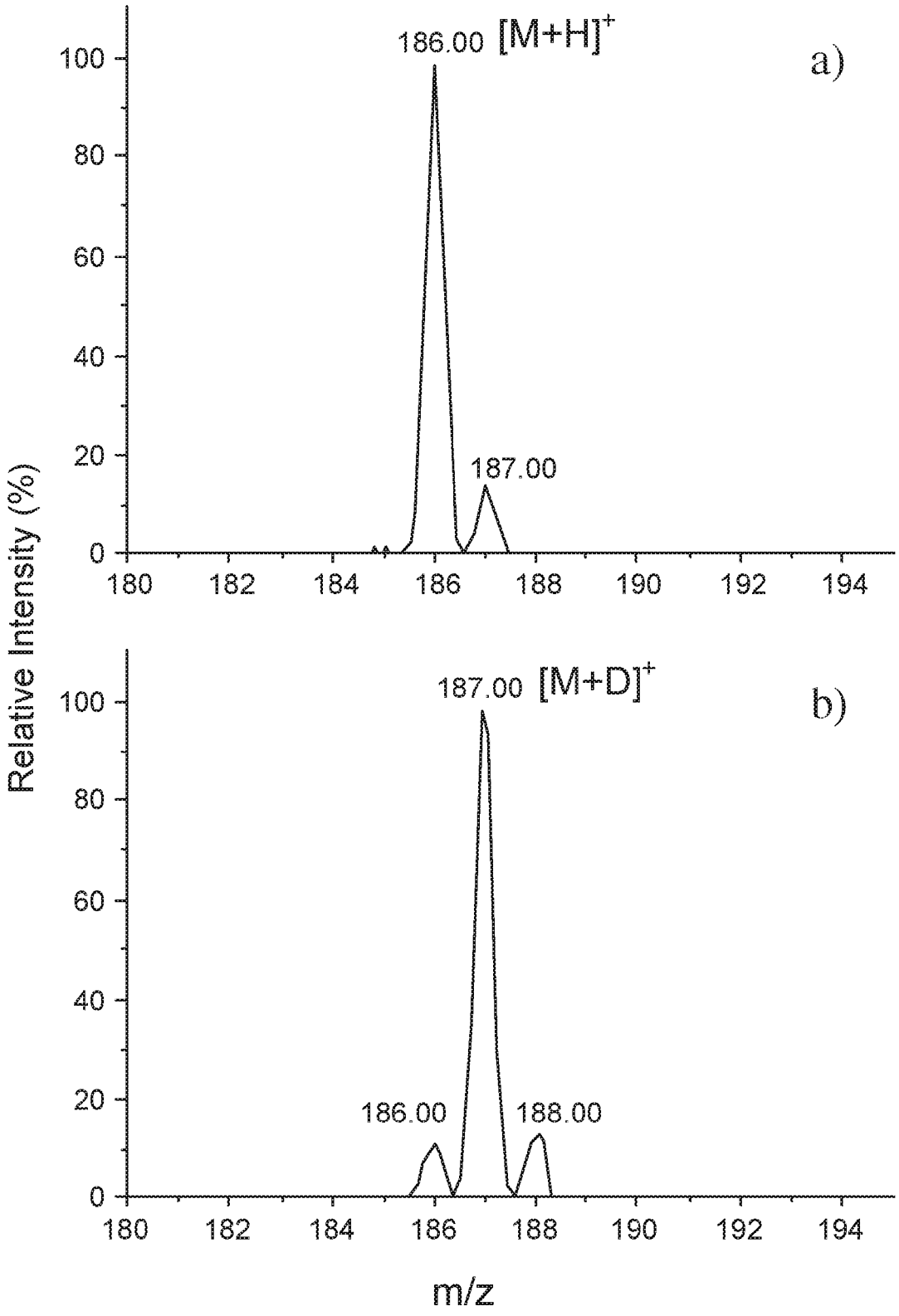
FIG. 7 panels A-B show zero volt PS mass spectra of 1 ppm tributylamine using (Panel A) methanol/water (v/v 1:1) as solvent and (Panel B) deuterated methanol/water (v/v 1:1) as solvent. When deuterated solvents are used, $[M+D]^+$ becomes the major peak.

FIG. 7 shows the zero volt PS MS of 1 ppm tributylamine by using methanol:water 1:1 and deuterated methanol:water 1:1 as solvents, respectively (FIG. 7 panels A-B). When methanol/water was used, m/z 186 ([M+H]+) was the dominant peak, the peak of m/z 187 is its isotopic peak. However, when deuterated methanol/water was used, m/z 187 ([M+D]+) was dominant and m/z 188 is its isotopic peak. These results indicate that the protons mainly come from the solvent. In FIG. 7 panel B, there is still a small peak of m/z 186 while in FIG. 7 panel A the m/z 185 is virtually absent. This indicates that there is still a small proportion of tributylamine ionized as $[M+H]^+$ when deuterated solvents are used. Possible sources of this proton include autoionization ($2M \rightarrow [M+H]^+ + [M-H]^-$), gas phase water molecules and residual protic molecules in the instrument.

Figure 8:
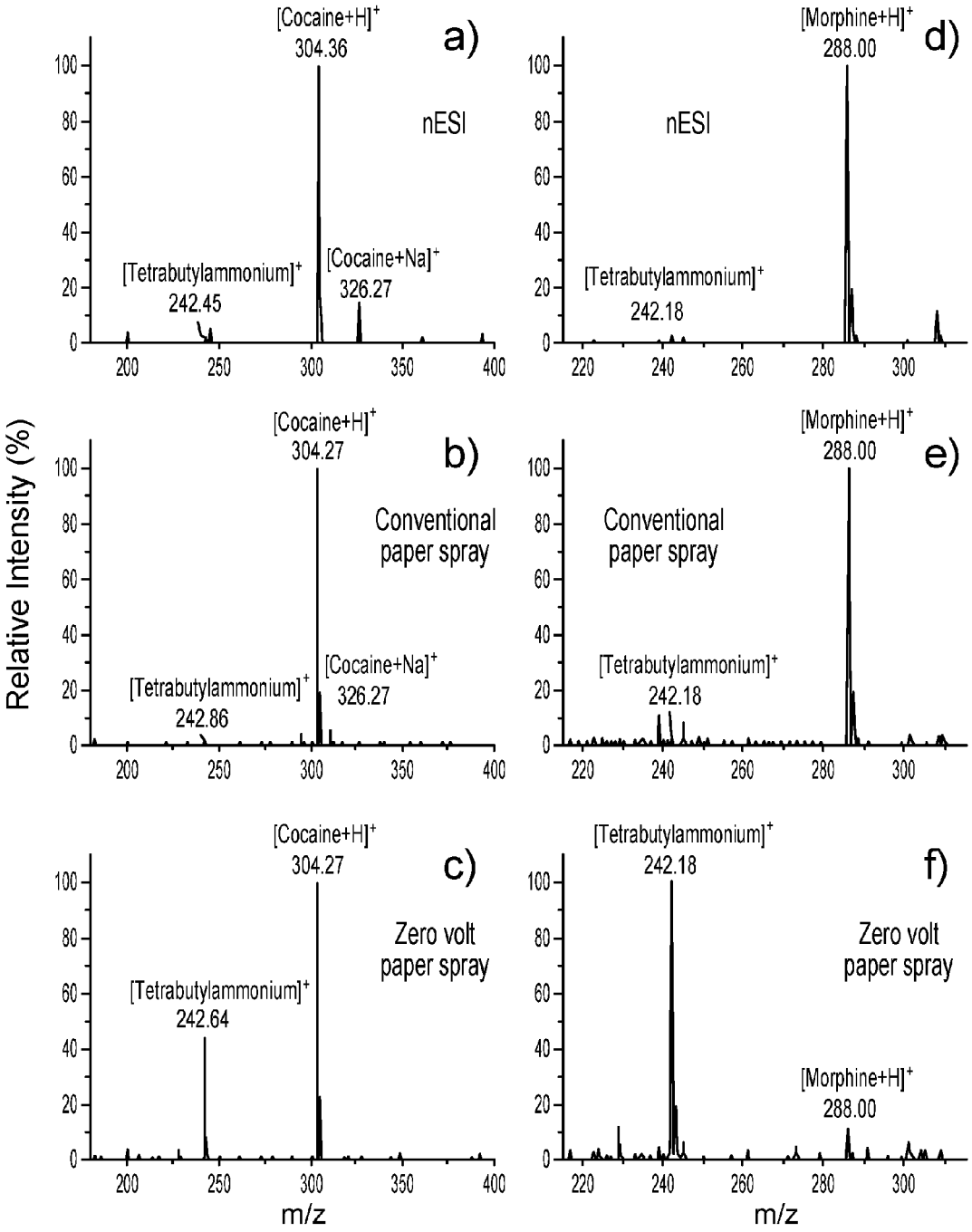
FIG. 8 panels A-C are mass spectra of a mixture of 9 ppm cocaine and 0.1 ppm tetrabutylammonium iodide using (Panel A) nESI, (Panel B) conventional PS and (Panel C) zero volt PS.

Analyzing Organic Salt/Organic Analyte Mixtures by Zero Volt PS, Conventional PS and nESI A mixture containing 9 ppm cocaine and 0.1 ppm tetrabutylammonium Iodide was detected by nESI, conventional PS and zero volt PS. The results are shown in FIG. 8 panels A-F. For nESI and conventional PS, cocaine (protonated molecule, m/z 304) is the dominant peak, while the signal intensity of tetrabutylammonium (m/z 242) is only about 2% of that of cocaine. For zero volt PS, m/z 304 is still dominant, but the relative intensity of tetrabutylammonium (m/z 242) is much higher than in nESI and conventional PS (about 50% of relative abundance). The ionization efficiency of zero volt PS is at least 25 times lower than nESI and conventional PS. The trend is even more obvious in the results of 9 ppm morphine/0.1 ppm tetrabutylammonium iodide (FIG. 8 panels D-F). The data for nESI (FIG. 8 panel D) and conventional PS (FIG. 8 panel F) show the signal for morphine (m/z 286) to be the base peak, while the relative abundance of tetrabutylammonium (m/z 242) is also only about 2% in both cases. However, in the zero volt PS result, m/z 242 becomes the main peak, whereas the relative intensity of the protonated morphine ion is only about 10%. This indicates that morphine's ionization efficiency at zero volts is decreased. The big difference between the results of cocaine and morphine indicates that the properties of the analyte play different roles in zero volt PS than in nESI and conventional PS.

As is known, in nESI or conventional PS, the signal intensity is closely related to the concentration of the analyte in the lower concentration range. It is observed that zero volt PS is 25 times less efficient than PS and nESI. In zero volt PS, it is assumed that the ionization efficiency is related to the ability of the analyte to form ions in solutions (i.e. deprotonation or protonation), since unlike electrospray, no excess charge is being added during the spray process. The numbers of ions an analyte forms depends on its dissociation constant, but is usually lower than the absolute concentration. This is one of the reasons for the lower ionization efficiency of zero volts PS compared with conventional PS and nESI. The charge contained in one droplet in zero volt PS is much lower than in nESI or in conventional PS; this means that there are less fission events in zero volt PS than in nESI and conventional PS. More fission events may lead to smaller droplets containing more analytes, and thus be more efficient ionization. All these will result in lower ionization efficiency. These differences can explain why zero volt PS is less efficient; however, they do not explain the change in cocaine to tetrabutylammonium iodide ratio. A plausible explanation is that during electrospray, excess charge is in the form of protons, which assist in the ionization of basic compounds, but in zero volt ionization is only based ion-separation. A secondary effect is that the addition of one analyte in excess may assist in lowering the analyte concentration by providing more fission cycles, thus improving ionization efficiency over the situation where the low concentration analyte is ionized by itself. To explain the differences in zero volt PS results of the two mixtures (cocaine vs. morphine), the pKb difference between cocaine and morphine is considered to play a role. The pKb of cocaine is 5.39 (15° C.), and morphine is slightly higher, 5.79 (25° C.). This means that morphine produces fewer ions than cocaine even when their absolute concentrations are the same. The main reason for the low relative intensity of morphine in zero volt PS is the surface activity difference between morphine and cocaine. It has been reported that morphine has a lower surface activity than cocaine. When mixing with the surface active compound tetrabutylammonium iodide, suppression of ionization is much more obvious for morphine than for cocaine in the zero volt PS case. In conventional PS and nESI, the surface activity factors are not so important since their ionization efficiencies are so high that most of the analytes in the droplets are ionized and pushed to the surface.

Overview of Ionization Mechanism for Zero Volt PS

It is well known that most of analytes that can be ionized by ESI (or nESI) or by PS are electrolytes. For a basic compound M dissolved in water, a certain amount of M exists in the ion pair form (normally as solvent-separated ion pairs) because of the dissociation equilibrium:

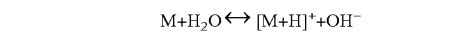

$$M+H_2O \leftrightarrow [M+H]^+ + OH^-$$

For negative ion generation, say an acidic compound N, the equilibrium is:

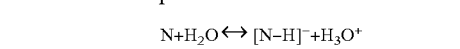

$$N+H_2O \leftrightarrow [N-H]^- + H_3O^+$$

It is these solution phase ion pairs that can go on to be evaporated and detected in zero volt PS as positive or negative ions.

Figure 9:
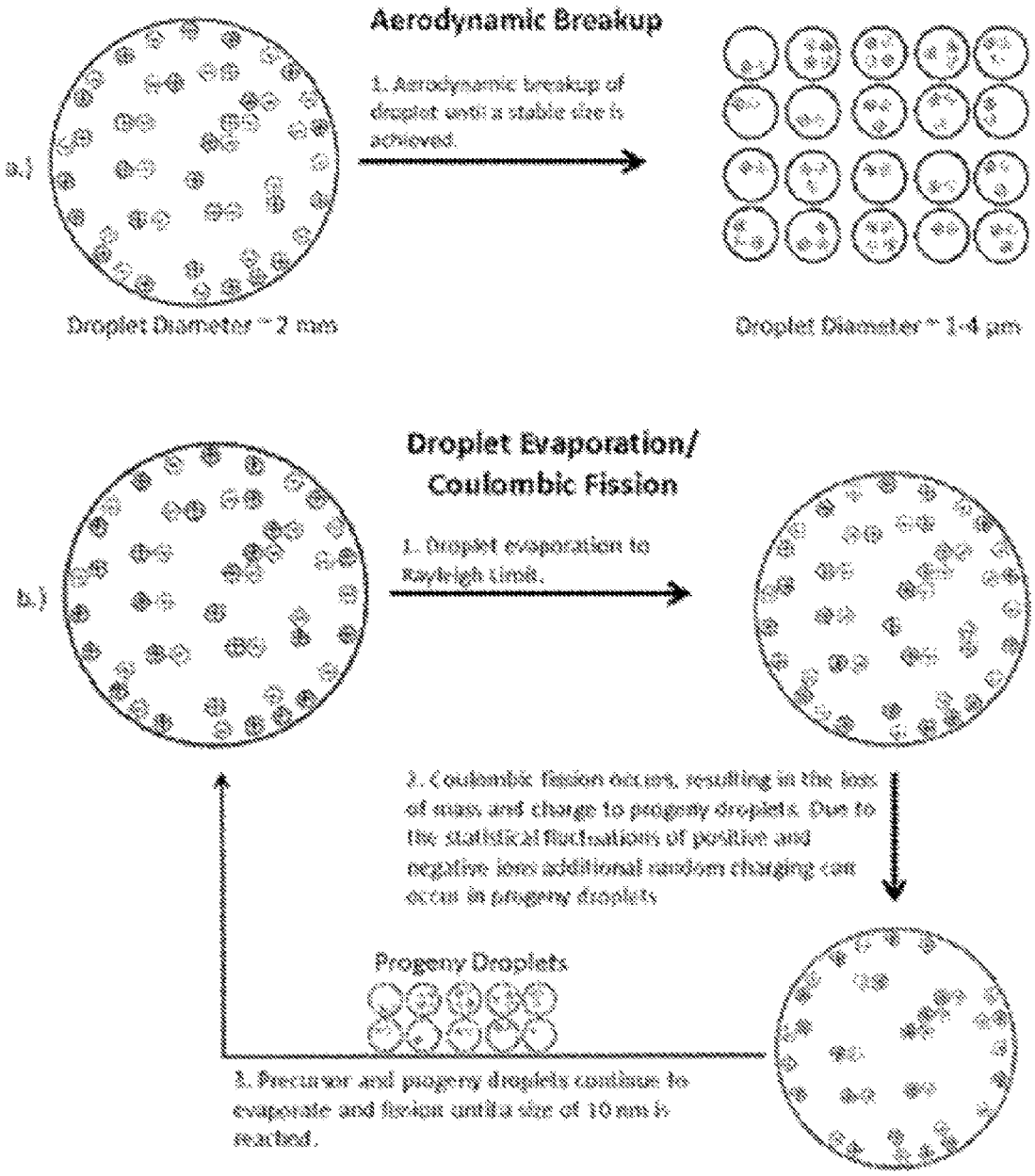
FIG. 9 panels A-B show an overview of the ionization mechanism of zero volt PS ionization. Panel A shows a representation of the aerodynamic breakup process and Panel B shows a representation of the droplet evaporation/coulombic fission simulation. Droplets are not drawn to scale. Final step of evaporation to dry ions is not shown.

In the zero volt PS process, a droplet experiences aerodynamic forces as it is pulled into the mass spectrometer by the suction of the vacuum system. These aerodynamic forces break apart the droplets until they reach a size on the order of 1 to 4 μm where the aerodynamic forces are no longer are strong enough to cause further droplet breakup. During the aerodynamic breakup process, there's a very large chance that the positive charges and negative charges will be evenly separated, that is to say, many of these progeny droplets will be slightly charged. After aerodynamic breakup it is assumed droplets will undergo multiple evaporation and Coulombic fission until they are ionized by either of the main ESI models, the charge residue model (CRM) or ion evaporation model (IEM). A schematic of the overall mechanism is shown in FIG. 9. The model used here to describe evaporative and fission is similar to other approaches used to model nESI based on Monte Carlo methods, except that droplet charging is determined by non-symmetrical fragmentation.

Simulations have been done based on the mechanism shown in FIG. 9 panels A-B. The initial concentration and diameter for each droplet were specified, but the charge of each droplet was randomly assigned based on a theory described by Dodd et al. (Journal of Applied Physics, 24 (1953) 73-80). To determine the initial charge, the number of ions an analyte forms in solution was calculated based on the initial concentration and dissociation constant of the analyte. Statistical fluctuations in the number of positive and negative ions in each droplet were modeled by a binomial distribution, and the final difference in ion polarity count determines the initial charge. It should be noted that charge is assumed to be carried only by analytes added to the solution. The droplet then evaporates until its diameter reaches the Rayleigh Limit. At the Rayleigh limit a droplet undergoes fission and produces progeny droplets. The number of analytes in each progeny droplet was determined from two Poisson distributions: the concentration of ions (both positive and negative) and the concentration of free ions in the outer region of the droplet. For the ion pairs, additional charging can arise from the statistical fluctuations in the number of positive and negative ions and this is modeled in the same manner as above. The evaporation/fission process continues until all droplets reach a size of 10 nm. At 10 nm, ions free of their counter charge are considered ionized (i.e. to undergo rapid desolvation), which is a simplification of the actual processes that allow for ion formation.

Aerodynamic Breakup

Figure 10:
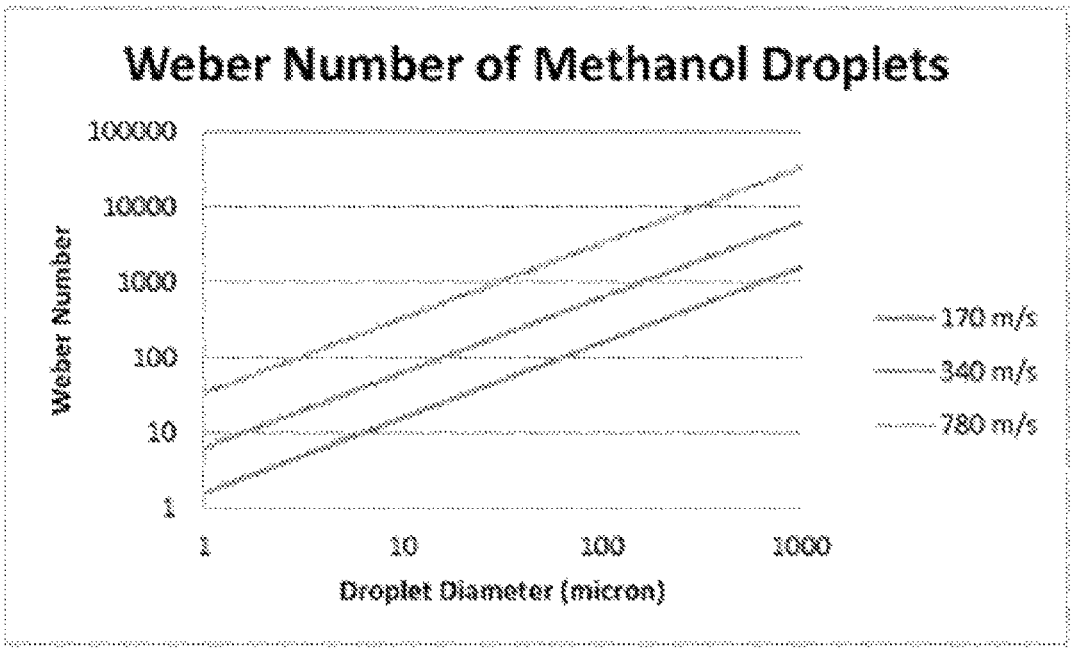
FIG. 10 is a graph showing simulation results of Weber number of methanol droplets. Using this information, it is assumed that droplets may have diameters between 1-4 μm after aerodynamic breakup.

When sufficient solvent is applied, droplets are pulled from the filter paper by the suction of the instrument. Typically a few μl of sample is added before each suction event suggesting that the initial droplets will be at least of similar volume. The droplets, initially at zero velocity enter a high speed gas flow (170 m/s) due to the suction of the inlet and experience an aerodynamic force. This force causes the droplet to simultaneously accelerate and breakup. The droplet will continue to breakup while its Weber number is larger than 10. The weber number is defined by:

$$We = \frac{Pg(V_g - V_d)^2 D_d}{o} \tag{1}$$

where $p_g$ is the gas density, $V_g$ is the gas velocity, $V_d$ is the droplet velocity, $D_d$ is the diameter of the droplet, and σ is the surface tension of the solvent. This suggests that droplets will primarily breakup due to aerodynamic forces until they either accelerate to the velocity of the surrounding gas or reach a certain size. There is evidence from charge detection mass spectrometry that the size of water droplets produced by either sonic spray ionization or vibrating orifice aerosol generator reach a common size of about 2.5 μm after traveling through the inlet. This is also approximately the average size measured for normal PS mass spectrometry. This suggests that methanol droplets should undergo a similar phenomenon, but in fact could be smaller due to the reduced surface tension of methanol as compared to water. Using this information, it is assumed that droplets may have diameters between 1-4 μm after aerodynamic breakup (FIG. 10).

Initial Droplet Conditions for Evaporation and Columbic Fission Cycles

Aerodynamic breakup determines that droplets will have diameters between 1 and 4 micron and this serves as the initial diameter of droplets modeled in this section. The number of analytes in a droplet was calculated based on initial analyte concentration and its dissociation constant to determine the number of ions it will produce. Only cation-anion pairs can be separated into detectable quantities by mass spectrometry, thus solution phase neutrals are ignored in this model. The initial droplet charge was modeled by the statistical fluctuations of positive and negative ions present in the total population of ion-pairs. For a droplet containing n ions, of which the ions are either positively or negatively charged, the overall charge is modeled by a binomial distribution.

$$f(z; n, p) = \binom{n}{p} p^z (1-p)^{n-z} \tag{2}$$

For this distribution, p is probability of an ion being charged (either positive or negative), n is the number of ions, and z is number of positive charges. The initial number of positive and negative ions on average is equal; however, statistical fluctuations in the positive and negative ions will produce some net charge. This is simulated by using a binomial random number generator with parameter p=0.5 and n is the previously calculated number of ions. The initial charge is found by subtracting the number of negative ions from the positive ions.

Droplet Evaporation to Rayleigh Limit

With the droplet's initial parameter set (size, charge, number of analyte), evaporation is allowed to occur. For computational purposes, the droplet's temperature does not change during evaporation. It was determined that the effect of temperature does not change the overall trend observed. The droplet is allowed to evaporate until it reaches the Rayleigh limit diameter.

$$D_R = \left(\frac{D_q^2 * e^2}{(\pi^2 * 8 * \epsilon_0 * Y)}\right)^{\frac{1}{3}} \tag{3}$$

where Dq is the charge on the droplets, e is elementary charge, $\epsilon_0$ is the permittivity of a vacuum, and $\gamma$ is the solvent surface tension. Surface tension was estimated using a regression method developed by Jasper.

Droplet Fission and Progeny Droplets

Upon reaching the Rayleigh Limit, droplets undergo fission and lose mass and charge in the form of progeny droplets. At this point columbic fission occurs with most reports indicating a small mass loss, Δm, (2%) from the precursor droplet and large charge loss, Δq, (15%). From this the diameter of the precursor and progeny droplets can be calculated, assuming on average 10 progeny droplets are generated in a fission event. The exact number of progeny droplets generated is unknown, but 10 are within the range of typical values reported. Accordingly the size of precursor and progeny droplets was calculated according to these equations:

$$D_d = (1 - \Delta m)^{\frac{1}{3}} * D_R \tag{4}$$

$$D_{pD} = \left(\frac{\Delta m}{N_{pd}}\right)^{\frac{1}{3}} D_R \tag{5}$$

where $N_{pd}$ is the number of progeny droplets taken to be 10 and Δm=0.02. At the time of fission only ions that are close to the surface are allowed the possibility of being transferred to a progeny droplet. A volume fraction, $V_f$, is specified as the volume which can be considered for transfer to progeny droplets. In this simulation it is taken to be 15% of the total volume, but no exact value is known. The position of the solvated ions is determined by their respective surface activity, S. This is modeled by a binomial distribution, similar to equation, except p=S, n is the number of ions, and z is the number of ions found in the outer region of the droplet. Thus when S=1 all ions are located in the outer region, and when S=0, none are located in the outer region. Any ions free of their respective counter charge are assumed to be in the outer region of the droplet. The average number of ions, $N_{IP}$, and charges, $N_q$, per progeny droplet are calculated.

$$N_{IP} = \left(\frac{D_d}{D_{pd}}\right)^3 * V_f * C_{IP} \tag{6}$$

$$N_q = \frac{C_q * \Delta q}{N_{pd}} \tag{7}$$

Where $C_{IP}$ and $C_q$ are the number concentration of ions and charges in the outer region of the droplet. The number of ions transferred to progeny droplets can be modeled by a Poisson distribution. The number of ions, $N_{anal\text{-}IP}$, and charges, $N_{anal\text{-}q}$ is chosen randomly from a Poisson distribution.

$$f(N_{anal-IP}, N_{IP}) = \frac{e^{-N_{IP}} * N_{IP}^{N_{anal-IP}}}{N_{anal-IP}!} \tag{8}$$

The same equation is used for $N_{anal\text{-}q}$ with the appropriate substitutions. At this point, more random charging can occur due to the statistical fluctuations of positive and negative ions present in the total population of positive and negative ions. This is modeled in the same manner as described in the initial droplet conditions section (equation 2). With this information the charge of the progeny droplet is calculated by subtracting the total population of positive ions from negative ions. This same methodology is completed for all the other progeny droplets, and then the conditions of the precursor droplet are updated based on the total number of ions consumed by the progeny droplets. All droplets (precursor and progeny) larger than 10 nm then undergo more evaporation/fission cycles until all droplets reach 10 nm in size.

Analyte Ion Formation

Once all droplets have reached 10 nm in size the simulation ends. At this time each droplet is analyzed for charge to determine the number of ionized analytes. For example, a droplet containing a +2 charge will have two ionized molecules. This counting process is repeated for all the droplets of size <10 nm and then ionization efficiency can be calculated. Typically 5,000-50,000 precursor droplets are modeled to obtain an estimate of ionization efficiency and total number of ionized molecules. Alternatively this model can be applied to droplets containing multiple analytes, in which case multiple analyte ratios can be calculated. Note that multiple charges on the small analytes of interest are very unlikely and this possibility is ignored.

Single Analyte Simulation

Figure 11:
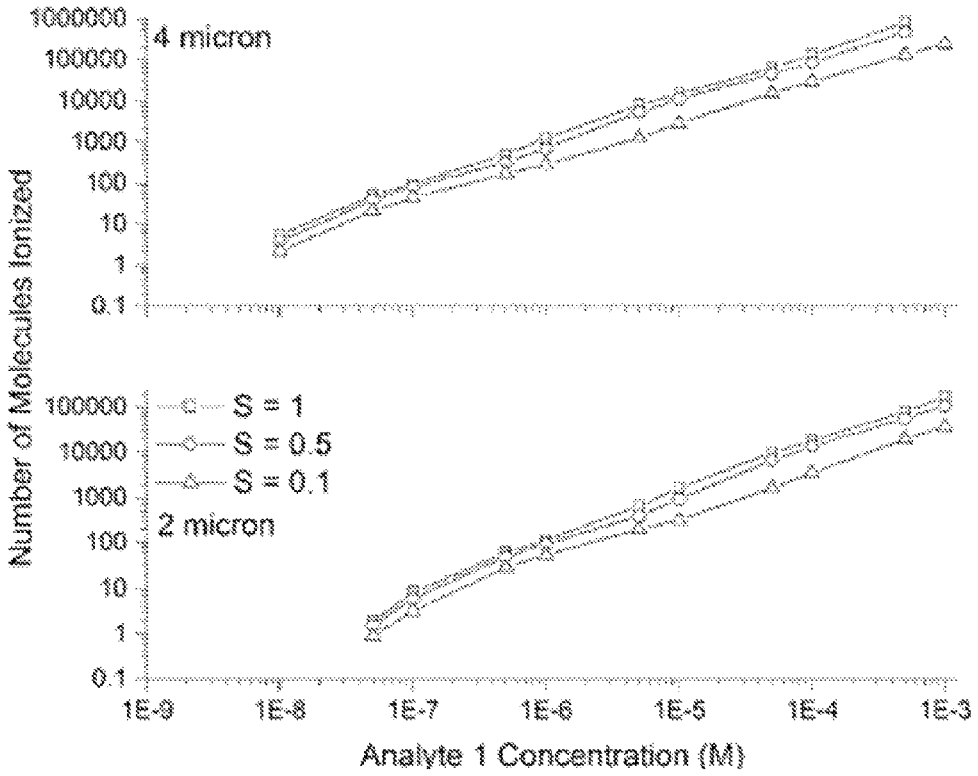
FIG. 11 is a set of graphs showing the number of ionized molecules vs. concentration for 2 micron (bottom) and 4 micron (top) droplets. The simulation was run at three different surface activities.
Figure 12:
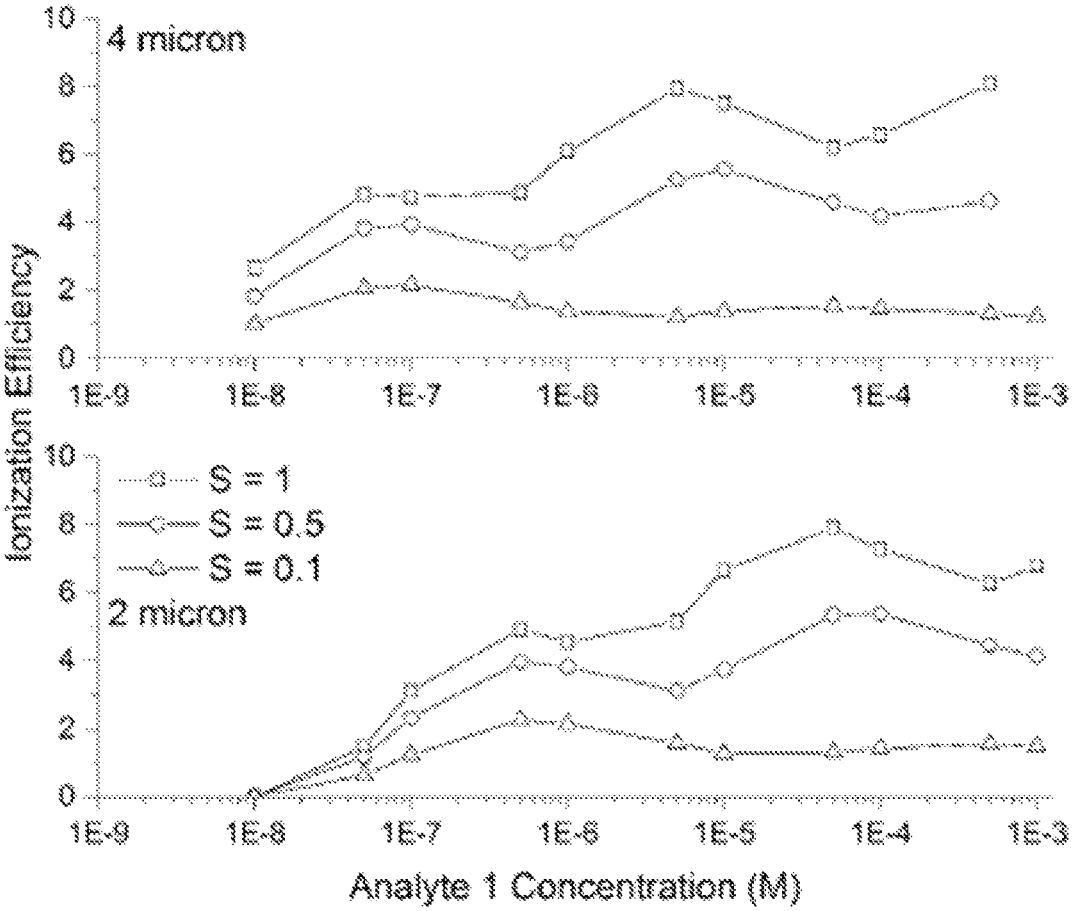
FIG. 12 is a set of graphs showing ionization efficiency vs. concentration of 2 micron (bottom) and 4 micron (top) droplets. The simulation was run at three different surface activities.

Simulations were run with 2 and 4 μm droplets to investigate the possible limits of detection of zero volt PS. Both sizes had limits of detection between $10^{-7}$ to $10^{-8}$ M (FIG. 11), based on the assumption of being able to detect a single ion. Qualitatively, 18 ppb of tetrabutylammonium iodide could be detected, which is equivalent to $4.87*10^{-8}$ M, which is in good agreement with what is detectable by simulation results. The simulation was also repeated at three different surface activities and the number of ionized molecules decreases as the surface activity decreases. Surface activity has a similar effect on the ionization efficiency (FIG. 12).

Mechanistic Considerations from a Multi-Analyte Mixture

Figure 13:
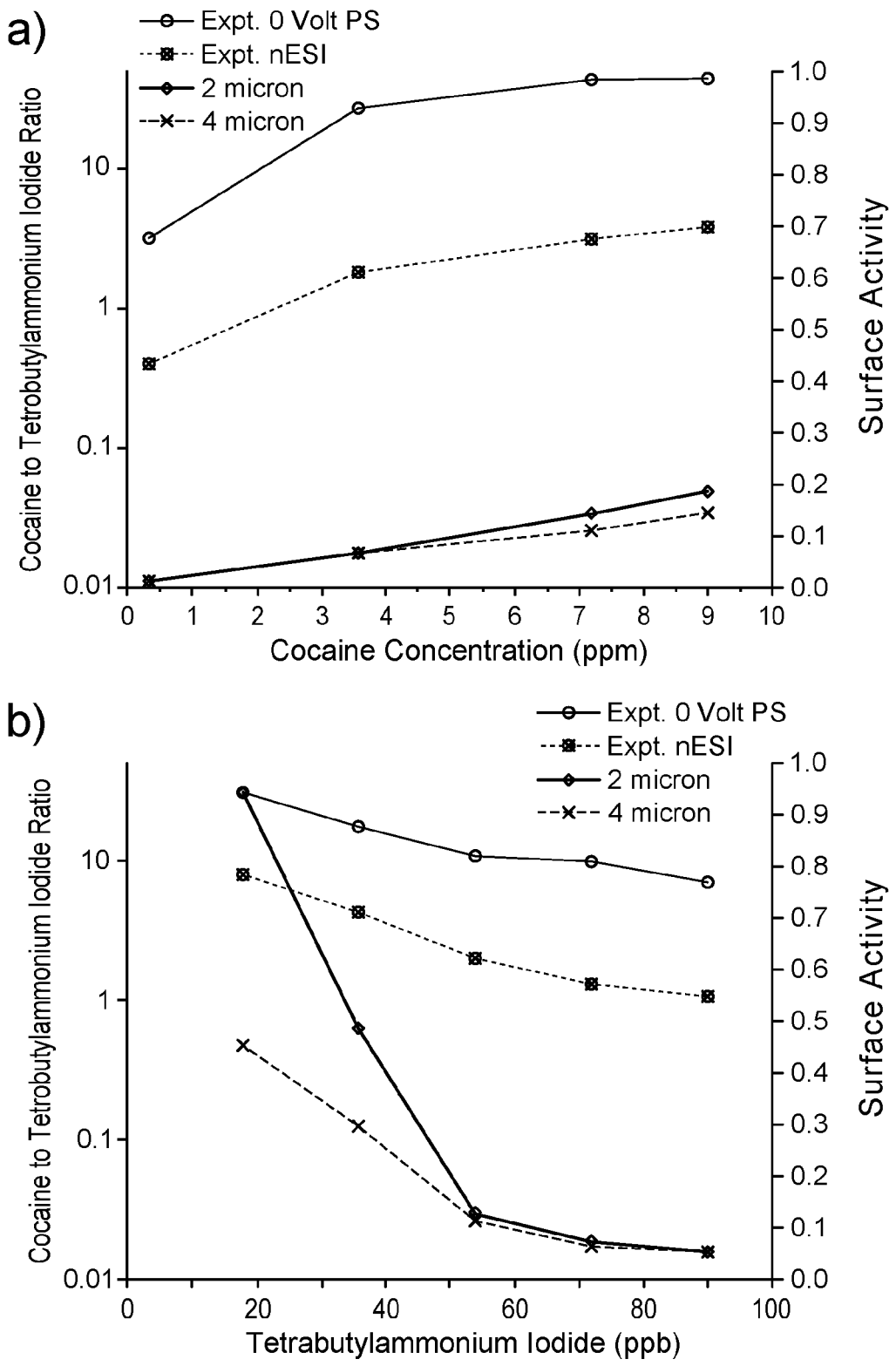
FIG. 13 panels A-B are graphs showing cocaine to tetrabutylammonium iodide ratio dependence for 0 Volt PS and nESI. The surface activity of cocaine is calculated to match the experimental 0 volt data, Panel A) Tetrabutylammonium iodide concentration is held constant at 0.1 ppm, while cocaine concentration changes, Panel B) Cocaine concentration is held constant at 1 ppm, while tetrabutylammonium iodide concentration changes.

A mixture of cocaine and tetrabutylammonium iodide was analyzed with zero volt PS and nESI. In FIG. 13 panel A the amount of cocaine was changed from 360 ppb to 9 ppm while the amount of tetrabutylammonium iodide was held constant at 0.1 ppm. In the second experiment (FIG. 13 panel B) the amount of cocaine was held constant at 1 ppm, while the amount of tetrabutylammonium iodide was changed between 18-90 ppb. At each point the ratio of cocaine to tetrabutylammonium iodide was calculated. Simulations were run, in which the surface activity of cocaine was varied until the simulated ratio matched within 1% of the experimental ratio. For these simulations the tetrabutylammonium iodide was assumed to have a nominal surface activity of 1.

In FIG. 13 panel A the surface activity of cocaine increased as the concentration of cocaine increased. From an intuitive standpoint this makes sense, since as more cocaine is added, more of it will be pushed to the surface and can compete against the tetrabutylammonium iodide for surface sites. Tang et. al. (Analytical Chemistry, 65 (1993) 3654-3668) developed a model, which suggests that at low concentrations, $10^{-8}$ to $5*10^{-6}$ M the ratio of analytes is dependent upon relative surface activities of the two analytes. When the same concentrations of analytes were analyzed by nESI, the ratio of cocaine to tetrabutylammonium iodide increased. The high voltage provides protons, which can serve to ionize the cocaine, but should not help in the ionization of tetrabutylammonium iodide. Thus the measured ratio becomes closer to the concentration ratio, with differences being due to ionization efficiency. FIG. 13 panel B shows a similar trend, but since the amount of tetrabutylammonium iodide is decreased the surface activity of cocaine increases. Again from an intuitive standpoint as the tetrabutylammonium iodide concentration decreases, more of the cocaine can occupy the surface and its surface activity will increase.

CONCLUSION

The analysis of analytes at zero volts from paper substrate has been demonstrated. Zero volt PS can give out both positive and negative signals, and allows detection of similar compounds as conventional PS and nESI, but with lower ionization efficiency. A mechanism for zero volt PS has been proposed based on the statistical fluctuation of positive and negative ions in solution. It is used to predict a detection limit similar to that observed experimentally. In the case of multiple analytes, the simulation is able to predict the relative surface activity of cocaine as function of varying analyte concentrations.

What is claimed is:

1. A system comprising:

a mass spectrometry probe comprising a porous material; and a mass spectrometer, wherein the system operates without an application of voltage to the probe.

2. The system according to claim 1, wherein the probe is oriented such that the porous material faces an inlet of the mass spectrometer and a distal end of the porous material is 5 mm or less from the inlet of the mass spectrometer.

3. The system according to claim 2, wherein the distal end comprises a tip comprised of the porous material.

4. The system according to claim 1, wherein the porous material is paper.

5. The system according to claim 4, wherein the paper is filter paper.

6. The system according to claim 1, wherein the mass spectrometer is a miniature mass spectrometer.

7. The system according to claim 1, further comprising a device for supplying solvent to the mass spectrometry probe.

8. The system according to claim 5, wherein a solvent is continuously supplied to the mass spectrometry probe.

9. The system according to claim 2, wherein the porous material comprises an internal standard.

10. The system according to claim 2, wherein the probe operates without pneumatic assistance.

11. A method for analyzing a sample, the method comprising:

providing a system comprising a mass spectrometry probe comprising a porous material, and a mass spectrometer, wherein the system operates without an application of voltage to the probe;

introducing a sample to the mass spectrometry probe; and analyzing sample droplets introduced into the mass spectrometer from the mass spectrometry probe.

12. The method according to claim 11, wherein the sample is a biological sample.

13. The method according to claim 12, wherein the biological sample is a body fluid.

14. The method according to claim 13, wherein the body fluid is blood or urine.

15. The method according to claim 11, wherein the probe is oriented such that the porous material faces an inlet of the mass spectrometer and a distal end of the porous material is 5 mm or less from the inlet of the mass spectrometer.

16. The method according to claim 15, wherein the distal end comprises a tip comprised of the porous material.

17. The method according to claim 11, wherein the porous material is paper.

18. The method according to claim 17, wherein the paper is filter paper.

19. The method according to claim 11, wherein the mass spectrometer is a miniature mass spectrometer.

20. The method according to claim 11, further comprising a device for supplying solvent to the mass spectrometry probe.

* * * * *